US009168781B1

(12) United States Patent
Cooper

(10) Patent No.: US 9,168,781 B1
(45) Date of Patent: Oct. 27, 2015

(54) PAINT TRAY WITH REMOVABLE PAINT SCREEN AND HANDLE

(71) Applicant: Greg Cooper, Jacksonville, FL (US)

(72) Inventor: Greg Cooper, Jacksonville, FL (US)

( * ) Notice: Subject to any disclaimer, the term of this patent is extended or adjusted under 35 U.S.C. 154(b) by 0 days.

(21) Appl. No.: 14/575,365

(22) Filed: Dec. 18, 2014

(51) Int. Cl.
*B65D 1/34* (2006.01)
*B44D 3/12* (2006.01)
*B65D 1/36* (2006.01)

(52) U.S. Cl.
CPC ..... *B44D 3/126* (2013.01)

(58) Field of Classification Search
CPC ..... B44D 3/126; B44D 3/128
USPC ..... 220/570, 571.1, 571
See application file for complete search history.

(56) References Cited

U.S. PATENT DOCUMENTS

| | | | | | |
|---|---|---|---|---|---|
| 1,813,670 | A | | 7/1931 | Kessler | |
| 2,444,096 | A | | 6/1948 | Faust | |
| 2,659,917 | A | * | 11/1953 | Drum | 15/257.06 |
| 2,694,825 | A | | 11/1953 | Fohl | |
| 3,761,995 | A | * | 10/1973 | Rinard | 15/257.06 |
| 3,940,824 | A | * | 3/1976 | Gioia et al. | 15/257.06 |
| 4,356,588 | A | * | 11/1982 | Martucci | 15/257.06 |
| 5,079,795 | A | * | 1/1992 | Schmid | 15/257.06 |
| 7,311,219 | B1 | * | 12/2007 | Kallas et al. | 220/570 |
| 7,703,631 | B2 | * | 4/2010 | Chafe et al. | 220/570 |
| 7,774,893 | B2 | | 8/2010 | Keane | |
| 2002/0005409 | A1 | * | 1/2002 | Rosa | 220/570 |
| 2003/0012887 | A1 | * | 1/2003 | Orlikowski | 427/428 |
| 2004/0226958 | A1 | * | 11/2004 | Robellard et al. | 220/772 |
| 2006/0054627 | A1 | * | 3/2006 | Youngs | 220/570 |
| 2006/0130264 | A1 | * | 6/2006 | Futo et al. | 15/257.06 |
| 2006/0225959 | A1 | * | 10/2006 | Pohl | 182/129 |

* cited by examiner

*Primary Examiner* — Mickey Yu
*Assistant Examiner* — Niki Eloshway
(74) *Attorney, Agent, or Firm* — Lawrence J. Gibney; Mitch Ghaneie

(57) ABSTRACT

This device is comprised of a paint tray, a handle, an attachable and removable paint screen, a canopy, and ladder step hooks. The screen attaches to the paint tray, which allows painters to roll off excess paint from their paint rollers. The excess paint will drip through the screen and drain to the deep end of the paint tray. The canopy, handle, and attachable paint screen provide painters with an alternative option of using the device in a vertical position rather than a horizontal position. The canopy additionally obstructs paint from spilling out when a painter is dipping the paint roller in the paint at the deep end of the paint tray and prevents any remaining paint in the tray from being contaminated with debris. The canopy and handle also provide painters with an option of holding the paint tray and a paint roller in each hand.

3 Claims, 4 Drawing Sheets

PAINT TRAY WITH REMOVABLE PAINT SCREEN AND HANDLE

BACKGROUND OF THE INVENTION

A. Field of the Invention

This relates to easily using and moving a paint tray. This device was originally contemplated to be used while painting with a paint roller but may also be used with a paint brush or any other tool for applying paint to a surface.

B. Prior Art

Paint trays have been in existence for almost a century. The first patent relating to a paint tray, Justus, U.S. Pat. No. 1,813,670, was filed in 1929. Justus disclosed a pan for holding paint and could be used to also keep brushes soft. Faust, U.S. Pat. No. 2,444,096, discloses a paint pan for use with roller type paint applicators. Fohl, U.S. Pat. No. 2,694,825, also discloses a paint tray that may be used with a paint roller. Since the 1950's there has been little innovation of the paint tray.

The typical paint tray today has an area used to hold paint, a downward slope from the front of the tray, which is the shallow end, to the back of the tray, which is the deep end where the paint is contained while in use. The tray is just wide enough so that a paint roller can roll down the slope towards the deep end of the tray. The painter reverses the direction and the roller can be removed to produce a smooth application when the paint is applied. Usually the paint tray will have various bumps along the slope of the tray that are intended to help remove the excess paint from the paint roller.

Although the development of the paint tray has proved to be valuable to the paint industry and to the everyday home-owner, there are two common problems associated with the use of the paint tray. First, after extended periods of use the bumps along the slope become slick with wet paint, which inhibits the paint roller from wiping or rolling off the excess paint. Second, when the deep end of the paint tray is full of paint it is difficult to move the tray without sloshing the paint out of the tray. Furthermore, it is very difficult to move or carry the paint tray with one hand and carry another object with the other.

The invention proposed in the present application aims to solve these two problems that have existed in the industry for decades.

BRIEF SUMMARY OF THE INVENTION

The present device is comprised of a paint tray with a shallow end and a deep end, a slope between the two ends, an attachable paint screen, a handle, a canopy extending over the deep end of the paint tray, and ladder step hooks that also function as feet located on the shallow end.

The paint screen attaches to the paint tray with a pair of tabs under which the paint screen will be placed and located towards the deep end of the tray and a pair of ball and socket connectors located towards the shallow end of the tray. The paint screen is slightly elevated off the surface of the paint tray so that the paint that drips off the screen can travel from the shallow end to the deep end.

The screen may be removed periodically so the tray and screen can be cleaned. The screen allows for the paint roller to consistently roll off excess paint before being applied to a surface. The roller will also not slide on the screen because the paint drips through the holes in the screen and drains to the deep end of the tray, rather than building up on the surface of the tray.

The screen being secured additionally allows for it to be used in a vertical orientation without falling towards the deep end of the tray.

A handle is attached to the outside surface of the shallow end of the tray, which helps with moving the tray around a room. Paint trays commonly sold at stores today have no handle. If the painter desires to move the tray, he or she must either carefully slide the tray across the ground or pick the tray up by its sides and carefully balance it to keep the paint from spilling out. Furthermore, the painter could not carry the paint roller and the tray at the same time without an increasing risk of spilling the paint. Having a handle coupled with a cover over the deep end of the tray enables a painter to carry the device vertically in one hand and the paint roller in the other hand.

NUMBERING REFERENCE

Figure 1:
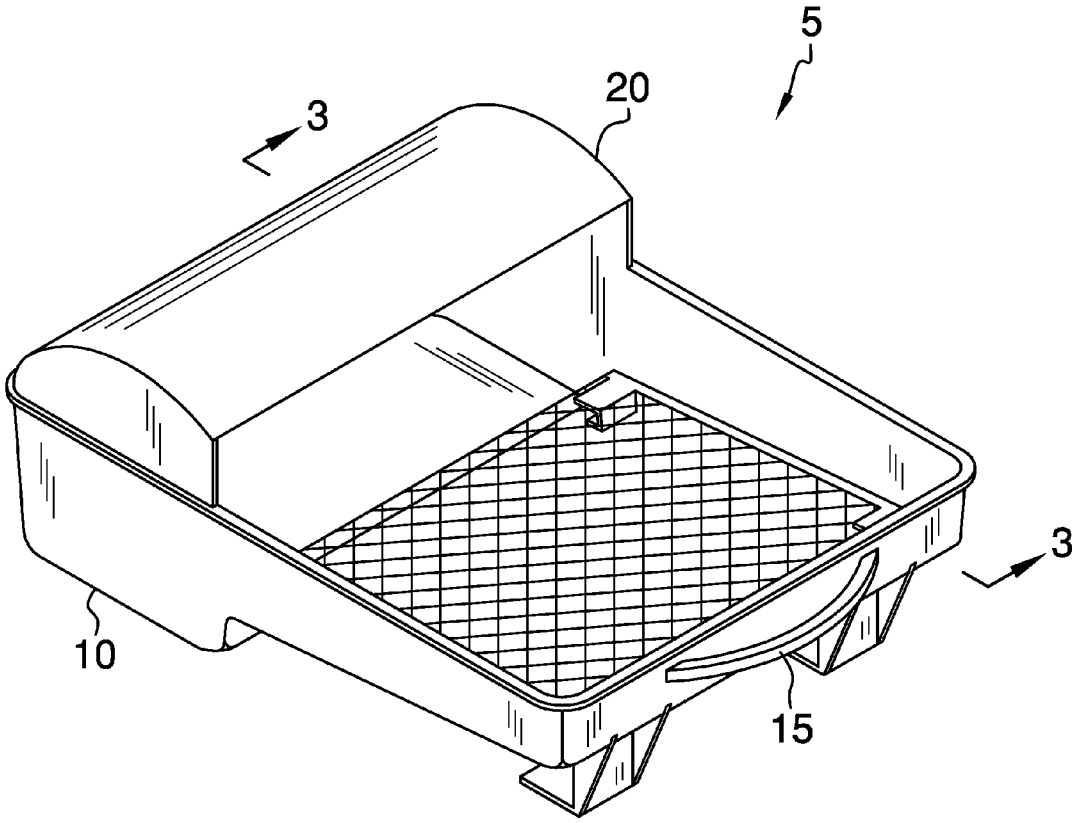
FIG. 1 is an isometric view of the device.
Figure 2:
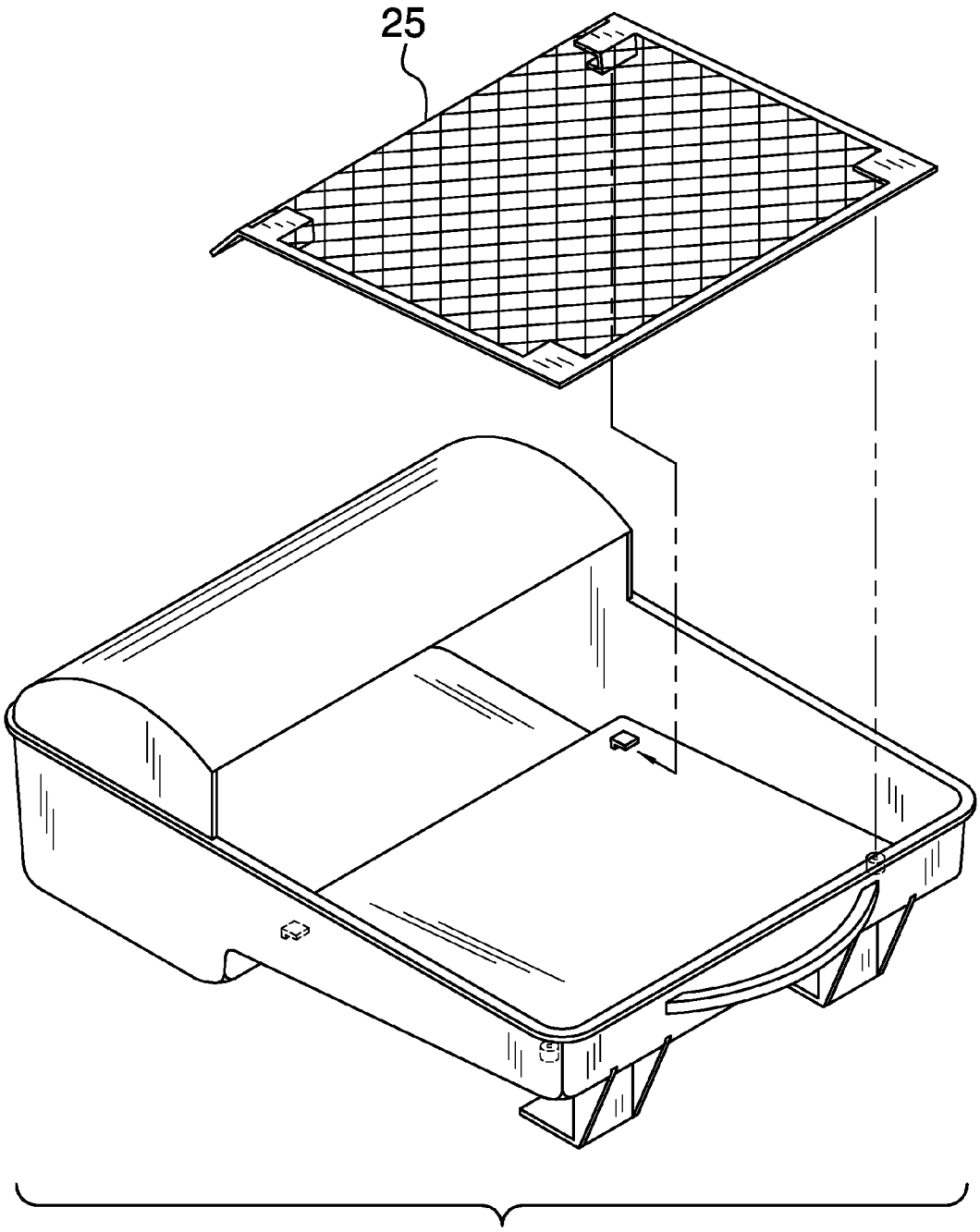
FIG. 2 is an isometric view depicting how the paint screen is attached to the paint tray.

5—Device
10—Paint Tray
15—Handle
20—Canopy
25—Removable Mesh Paint Screen
30—Paint Tray Tab
31—Paint Screen Tab
35—Paint Screen Snap
36—Ball Socket Post
40—Ladder Step Hook

DETAILED DESCRIPTION OF THE EMBODIMENTS

This device 5 is comprised of a paint tray 10 with a shallow end that slopes down toward a deep end, a handle 15 that is attached to the exterior of the shallow end of the paint tray 10, a canopy 20 that covers the deep end of the paint tray 10, an attachable and removable mesh paint screen 25, and a pair of ladder step hooks 40 that also operate as feet. This device may be used in a horizontal or vertical position. The deep end of the paint tray 10 will hold the paint. It should be noted that although this device is described as being used with a paint roller, it may also be modified and used with other painting tools, such as but not limited to, paint brushes, flat foam paint brushes, and paint edgers.

The canopy 20 extends from the back wall of the deep end of the paint tray 10 and covers a predetermined amount of the paint in the paint tray. The canopy may be slightly arced as depicted in FIG. 3 or may be provided without an arc to remain parallel with the ground during normal operation.

The canopy 20 has primarily three functions. The first is to prevent paint from splashing out when a paint roller is being dipped into it. The second is to allow a painter to carry the device vertically by the handle 15, without the paint from spilling out. The third is to help prevent debris from falling into the paint when not in use.

Figure 4:
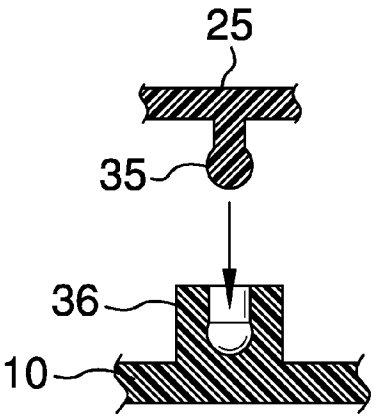
FIG. 4 is a cross-sectional view of how one end of the paint screen could be attached to the paint tray.
Figure 5:
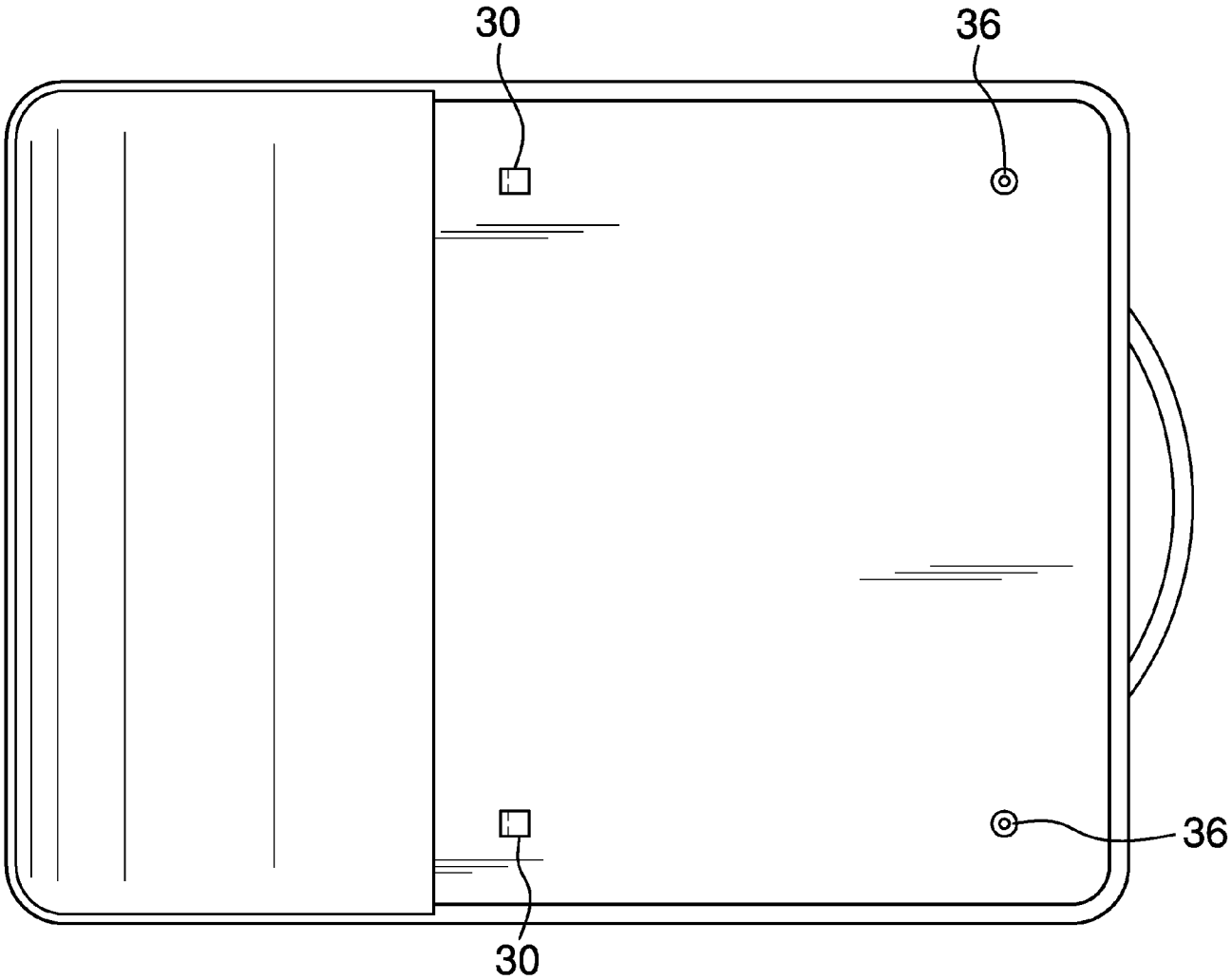
FIG. 5 is a top view of the device shown without the paint screen.

The paint screen 25 attaches to the paint tray 10 on the sloped region of the paint tray 10. The paint screen 25 is shown to attach to the bottom surface of the tray 10 with a pair of paint screen snaps 35 on the bottom surface of the paint tray and a pair of ball socket posts 36 on the paint tray surface 10 such as depicted in FIG. 4. The paint screen snaps 35 will be inserted into the ball socket posts 36 during normal operation.

Figure 3:
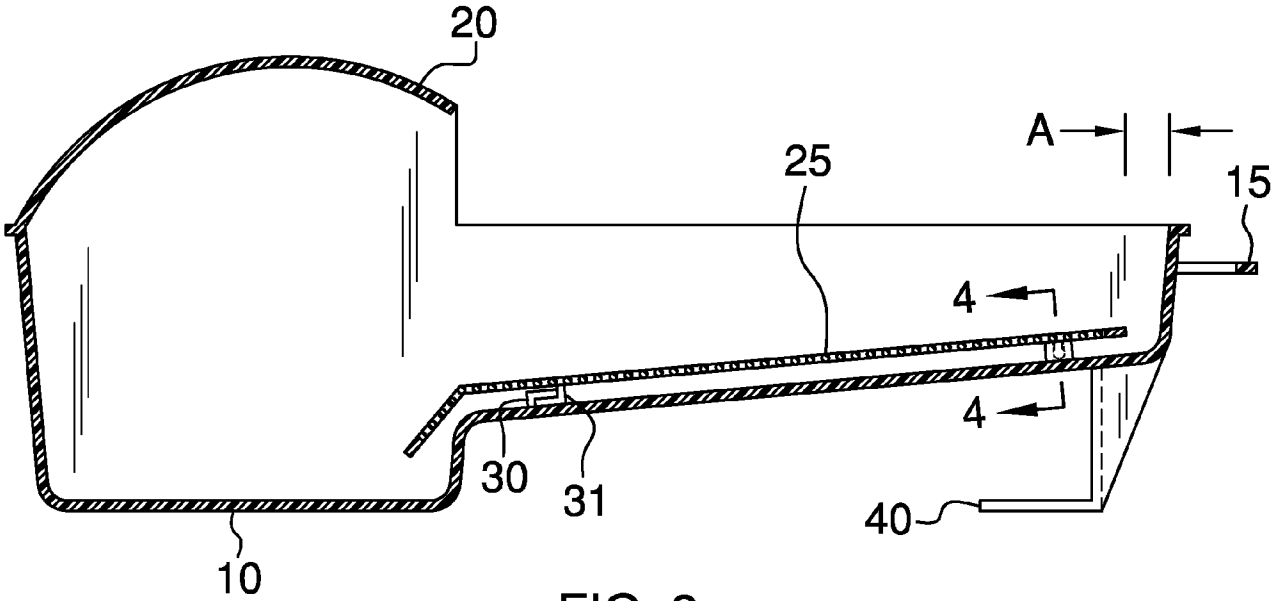
FIG. 3 is a cross-sectional view of the device depicting the paint screen attached at the sloping portion of the paint tray, a canopy over the deep end of the paint tray, and a handle attached to the shallow end of the tray.

A gap, which is depicted as reference "A" in FIG. 3 positions the screen so that the end of the screen does not abut the interior of the paint tray. The gap prevents the roller that is being used from contacting the interior surface of the tray and thereby insures that the paint from the roller does not foul the handle area of this device. In operation if the person attempts to push the roller past the end of the screen the roller would drop in the gap and would be prevented from any further movement.

A pair of paint screen tabs 31 on the paint screen 25 are placed under the pair of paint tray tabs 30. However, it is contemplated that a variety of connections may be used to attach the screen 25 to the tray 10.

By securing the paint screen to the tray 10 by sliding the paint screen tabs 31 under the paint screen tabs 30 it prevents the screen 25 from sliding or moving while the paint roller is rolled across it. In addition, the securement means prevent the screen 25 from falling down when the device is being carried vertically, thereby allowing the screen 25 to be utilized when the device is sitting horizontally or vertically.

The screen 25 having holes or a lattice surface with openings provides better traction for wet paint rollers because the paint does not build up on the screen like it does on the surface typically used by all other disclosed paint trays. Rather than the paint drying on a flat or bumpy surface, the paint drips through the holes in the screen 25 down to the bottom surface of the paint tray and then towards the deep end of the tray 10.

While the embodiments of the invention have been disclosed, certain modifications may be made by those skilled in the art to modify the invention without departing from the spirit of the invention.

The inventor claims:

1. A device, which is comprised of:

a. a paint tray;
- wherein the paint tray has a shallow end and a deep end;
- said paint tray has a sloped portion which is sloped from the shallow end to the deep end;
- wherein said paint tray has an interior surface and an exterior surface;
- wherein a pair of paint tray ball socket posts are provided;

b. a handle;
- wherein the handle is attached to the paint tray;

c. a pair of ladder step hooks;
- wherein the pair of ladder step hooks are attached to the paint tray on the exterior surface of the paint tray;
- wherein the ladder step hooks allow the device to rest horizontally;
- wherein the ladder step hooks allow the device to hang from the steps of a ladder;

d. a paint screen;
- wherein the paint screen is of a predetermined shape;
- wherein the paint screen is planar;
- said paint screen has an upper surface and a lower surface;
- said paint screen has a first end and a second end;
- said first end is proximate to the shallow end of the paint tray;
- said second end is proximate to the deep end of the paint tray;
- wherein the paint screen has a plurality of openings;
- wherein a pair of paint screen snaps are provided;
- wherein the paint screen snaps extend below the lower surface of the paint screen;
- wherein said pair of paint screen snaps mate with said pair of ball socket posts;
- wherein the ball socket posts extend upwardly from the interior surface of the paint tray;
- wherein a pair of paint screen tabs is provided on the lower surface of the paint screen;
- wherein a pair of paint tray tabs is provided on the paint tray;
- said paint screen tabs are placed below the paint tray tabs;

e. a canopy;
- wherein the canopy is attached to the paint tray;
- wherein the canopy is of a predetermined shape;
- said canopy covers the area over the deep end of the paint tray;

f. a gap;
- wherein the gap is provided at the first end of said paint screen.

2. The device as described in claim 1 wherein the canopy is arced.

3. The device as described in claim 1 wherein the canopy is straight.

* * * * *